US005813882A

United States Patent [19]

Saito et al.

[11] Patent Number: 5,813,882

[45] Date of Patent: Sep. 29, 1998

[54] CONNECTOR DEVICE

[75] Inventors: Hitoshi Saito; Hisashi Tsukamoto, both of Shizuoka, Japan

[73] Assignee: Yazaki Corporation, Tokyo, Japan

[21] Appl. No.: 731,931

[22] Filed: Oct. 16, 1996

[30] Foreign Application Priority Data

Oct. 20, 1995 [JP] Japan ..... 7-272992

[51] Int. Cl.[6] ..... H01R 13/40

[52] U.S. Cl. ..... 439/595; 439/940; 29/426.1; 29/758

[58] Field of Search ..... 439/595, 752, 439/940, 923; 29/426.1, 700.758

[56] References Cited

U.S. PATENT DOCUMENTS 5,346,414 9/1994 Sakai et al. ..... 439/752

5,603,642 2/1997 Shinji et al. ..... 439/752

*Primary Examiner*—P. Austin Bradley

*Assistant Examiner*—T. C. Patel

*Attorney, Agent, or Firm*—Sughrue, Mion, Zinn, Macpeak & Seas, PLLC

[57] ABSTRACT

A connector device includes a housing, terminal accommodating chambers formed in the housing, the terminal accommodating chambers into which terminals are inserted, a front holder, for fixing the terminals, inserted into a front portion of the housing, and a drawing portion formed on the front holder, the drawing portion having an opening for engaging with a drawing tool, the opening having a pair of sloped guide surfaces for regulating the drawing tool in a predetermined direction, whereby the front holder can be drawn out smoothly.

7 Claims, 5 Drawing Sheets

CONNECTOR DEVICE

BACKGROUND OF THE INVENTION

1. Field of the Invention

The invention relates to a connector device for electric wires, and more particularly to a structure of a connector device having a front holder.

2. Background

An exemplary construction of a conventional connector device, in which a plurality of male terminals or female terminals connected to a plurality of electric wires are collectively accommodated in a housing so as to be connectable to a mating housing, is shown in FIGS. 6 to 8.

FIG. 6 is a longitudinal sectional view of a conventional connector 1', and FIG. 7 is an exploded perspective view showing the connector 1'.

The connector 1' includes a housing 2' that is formed by injection-molding a synthetic resin, a front holder 3, a mat seal 4', a mat seal cover 5', and a plurality of male terminals 6' that are connected to electric wires.

The housing 2' has a hood portion 2*a*' that protects electric connections 6*a*' of the male terminals 6'. A plurality of terminal accommodating chambers 7' are formed in the housing 2'. The terminal accommodating chambers 7' allow the electric connections 6*a*' of the plurality of male terminals 6' to be inserted thereinto so that the male terminals can be separated from one another. Further, a lance 9' is arranged in each terminal accommodating chamber 7'. The lance 9' has a protuberance that is engageable with a recess 8' arranged in the barrel portion of the corresponding male terminal 6'.

The front holder 3 is inserted into the hood portion 2*a*' side that is the front end of the housing 2' so that the electric connections 6*a*' of the male terminals 6' pass through a plurality of holes 11' bored through a partitioning portion 10', and further, a plurality of spacers 12' projecting from the partitioning portion 10' are fitted into grooves 13'. The grooves 13' serve as spaces for allowing the lances 9' to be flexed therein and are formed adjacent to the terminal accommodating chambers 7' within the housing 2'.

The retaining protuberance arranged on the lance 9' engages with the recess 8' of the corresponding male terminal 6', so that the flexion of the lance 9' is regulated by the spacer 12' fitted into the groove 13'. As a result of this construction, the male terminal 6' can be thoroughly fixed. The mat seal 4' and the mat seal cover 5' are attached to an end portion of the housing 2' so that the respective electric wires passing therethrough can be sealed.

The thus constructed conventional connector 1' requires that an operator remove the front holder 3 for inspection and maintenance in the vicinity of the terminals. That is, the operator must remove the front holder 3 that is attached to the hood portion 2*a*' of the housing 2'. To allow the operator to do this, as shown in FIG. 8, a drawing tab 15 is arranged so as to project from inside a circumferential wall portion 14' and an opening 16 with which a drawing tool 17 having a substantially L-shaped cross section is engageable, is formed in the drawing tab 15 in which a portion defined by a circle VIII in FIG. 7 is shown in enlarged form.

However, the opening 16 is rectangular, and the drawing width W thereof is set to a value substantially equal to the drawing width Y of the drawing tool 17. Therefore, the drawing tool 17 has not been inserted into the opening 16 so smoothly. When the drawing width Y of the drawing tool 17 is narrowed, a gap is provided in the area of contact between the drawing tool 17 and the opening 16, which does not allow the drawing force to be applied stably in a predetermined direction. As a result, the front holder 3 cannot be drawn out smoothly.

SUMMARY OF THE INVENTION

The invention has been made to overcome the aforementioned problems addressed by the conventional connector device. The object of the invention is therefore to provide a connector device that can draw out the front holder more smoothly.

The object of the invention can be achieved by a connector device having terminals inserted into terminal accommodating chambers of a housing and fitting a terminal fixing front holder to the terminal accommodating chambers from a front end portion of the housing, the connector device of the invention features that a drawing portion is arranged on the terminal fixing front holder, and an opening having sloped guide surfaces that can regulate a drawing direction is formed in the drawing portion.

The object of the invention can also be achieved by a connector device in which the opening has triangular sloped guide surfaces.

The object of the invention can also be achieved by a connector device in which the drawing portion has an opening having sloped guide surfaces bored through a drawing tab being arranged adjacent to a circumferential wall portion of the terminal fixing front holder.

The object of the invention can also be achieved by a connector device in which the drawing portion has an opening having sloped guide surfaces directly bored through the circumferential wall portion of the terminal fixing front holder.

The connector device, in which terminals are inserted into terminal accommodating chambers of a housing and a terminal fixing front holder is fitted into the terminal accommodating chambers from a front end of the housing, the connector device of the invention features that a drawing portion is arranged on the terminal fixing front holder, and an opening having sloped guide surfaces that can regulate a drawing direction is formed in the drawing portion. Therefore, the position at which the drawing tool is engaged with the opening is fixed with the drawing tool guided by the sloped guide surfaces, and further, the drawing force of the drawing tool can also be applied stably in a predetermined direction.

Since the connector device of the invention includes the opening that has the triangular sloped guide surfaces for drawing in particular, the drawing force is allowed to concentrate on the apex of the triangle, so that the direction in which the drawing force is applied is regulated toward the apex.

The connector device of the invention further features a drawing portion which has an opening having sloped guide surfaces bored through a drawing tab that is arranged adjacent to a circumferential wall portion of the terminal fixing front holder. Therefore, the operation of engaging the drawing tool with the opening is further facilitated, and further, the drawing tool is engaged at a fixed position along the sloped guide surfaces. As a result, the drawing force of the drawing tool can be applied further stably in a predetermined direction.

The connector device of the invention further features the drawing portion and has an opening having sloped guide surfaces directly bored through the circumferential wall portion of the terminal fixing front holder. Therefore, the layout of the fitting areas within the hood portions of the male and female housings becomes simple, which in turn contributes to improving connector connecting operability.

DETAILED DESCRIPTION OF THE PREFERRED EMBODIMENTS

Figure 1:
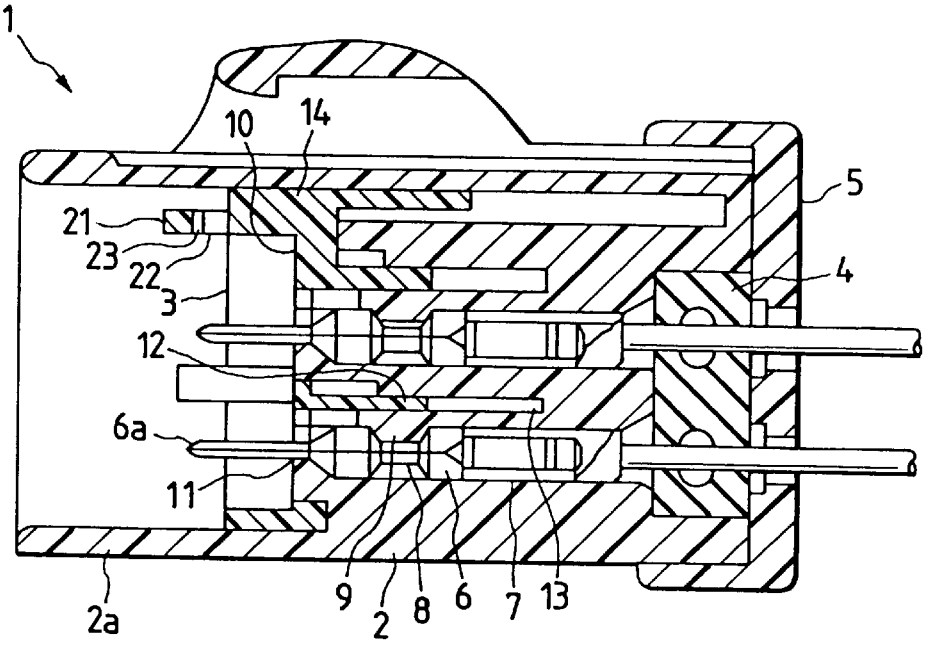
FIG. 1 is a longitudinal sectional view of a connector of the invention having a male terminal.

A connector device, which is an embodiment of the invention, will now be described in detail with reference to the accompanying drawings.

The connector device of the invention has substantially the same construction as the aforementioned conventional connector device except for the front holder thereof. That is, a connector 1 includes a housing 2 that is formed by injection-molding a synthetic resin, a mat seal 4, a mat seal cover 5, and a plurality of male terminals 6 that are connected to electric wires.

The housing 2 has a hood portion 2*a* that protects electric connections 6*a* of the male terminals 6. Inside the housing 2 are a plurality of terminal accommodating chambers 7. The terminal accommodating chambers 7 allow the electric connections 6*a* of the plurality of male terminals 6 to be inserted thereinto so that the male terminals can be separated from one another. Further, a lance 9 is arranged in each terminal accommodating chamber 7. The lance 9 has a protuberance that is engageable with a recess 8 arranged in the barrel portion of the corresponding male terminal 6.

The mat seal 4 and the mat seal cover 5 are attached to an end portion of the housing 2 so that the respective electric wires passing therethrough can be sealed, the end being as viewed in a terminal insertion direction.

On the other hand, a front holder 20 of the invention is also inserted into the hood portion 2*a* from the front end portion of the housing 2 in a manner similar to the conventional front holder 3 so that the electric connections 6*a* of the male terminals 6 pass through a plurality of holes 11 bored through a partitioning portion 10, and further, a plurality of spacers 12 projecting from the partitioning portion 10 are fitted into grooves 13. The grooves 13 serve as spaces for allowing the lances 9 to be flexed therein and are formed adjacent to the terminal accommodating chambers 7 within the housing 2.

The spacer 12 fitted into the groove 13 regulates the flexion of the lance 9. Therefore, the lance 9 can be thoroughly fixed while engaged with the recess 8 of the corresponding male terminal 6.

Further, the front holder 20 has a circumferential wall portion 14 along the inner surface of the hood portion 2*a*. As a result of this construction, the front holder 20 is prevented from playing.

Figure 2A:
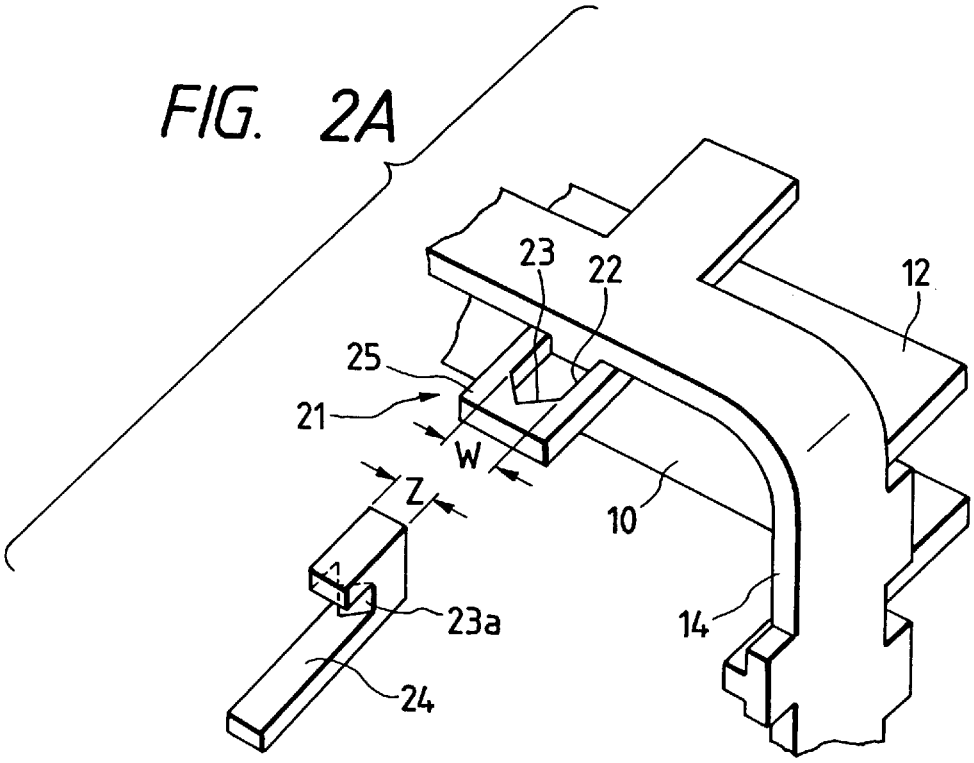
FIG. 2A is a partially enlarged perspective view showing a front holder to be used for a connector having a male terminal in a connector device of the invention.
Figure 2B:
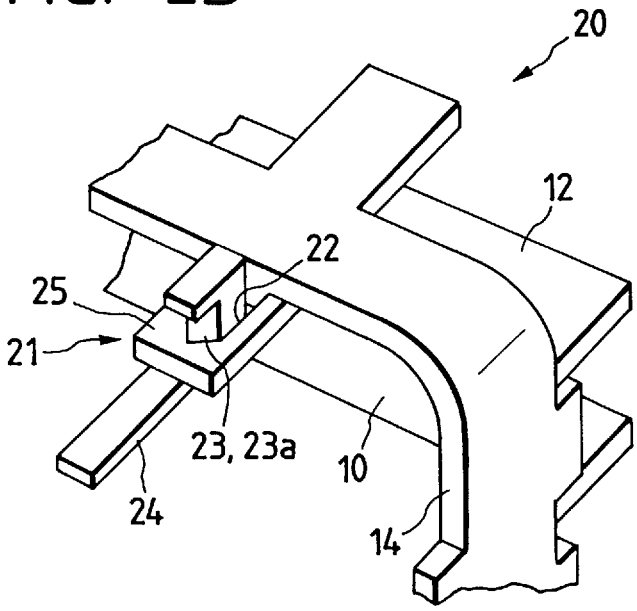
FIG. 2B is a perspective view of the front holder with a drawing tool engaged with a drawing tab.

Further, as shown in FIGS. 2A and 2B in enlarged form, a drawing tab 21 is arranged so as to project from the inside of the circumferential wall portion 14. An opening 22 engageable with a drawing tool 24 having a substantially L-shaped cross section is formed in the drawing tab 21.

It may be noted that the opening 22 has sloped guide surfaces 23, which extend from the apex of a triangle. The drawing width W of the opening 22 is set to a value about 1.5 times the drawing width Z of the drawing tool 24.

As shown in FIG. 2A, the drawing tool 24 has sloped engaging surfaces 23*a* for engaging with the sloped guide surfaces 23 of the opening 22.

As described above in detail, the connector device of the invention, in which the male terminals 6 are inserted into the terminal accommodating chambers 7 of the housing 2 and the terminal fixing front holder 20 is fitted into the terminal accommodating chambers 7 from the front end portion of the housing 2, features arranging the drawing portion 21 in the terminal fixing front holder 20, and further, boring the opening 22 in the drawing portion 21, the opening 22 having the sloped guide surfaces 23 that can regulate the drawing direction. Therefore, the drawing tool 24 is guided in a predetermined direction along the sloped guide surfaces 23 with respect to the opening 22, so that the position of engagement of the drawing tool 24 can be fixed every time the drawing tool 24 is engaged, which in turn allows the drawing force of the drawing tool 24 to be applied stably in a predetermined direction as well.

Since the connector device of the invention includes the opening 22 that has the triangular sloped guide surfaces 23 for drawing in particular, the drawing force is allowed to concentrate on the apex of the triangle, so that the direction in which the drawing force is applied is regulated toward the apex.

Further, the connector device of the invention features that the drawing portion 21 has the drawing tab 25 with the opening 22 bored therethrough, the drawing tab 25 being arranged adjacent to the circumferential wall portion 14 of the terminal fixing front holder 20 and the opening 22 having the sloped guide surfaces 23. Therefore, the operation of engaging the drawing tool 24 with the opening 22 can be further facilitated, and further, the position of engagement of the drawing tool 24 can also be fixed with the drawing tool 24 guided by the sloped guide surfaces 23.

Figure 3:
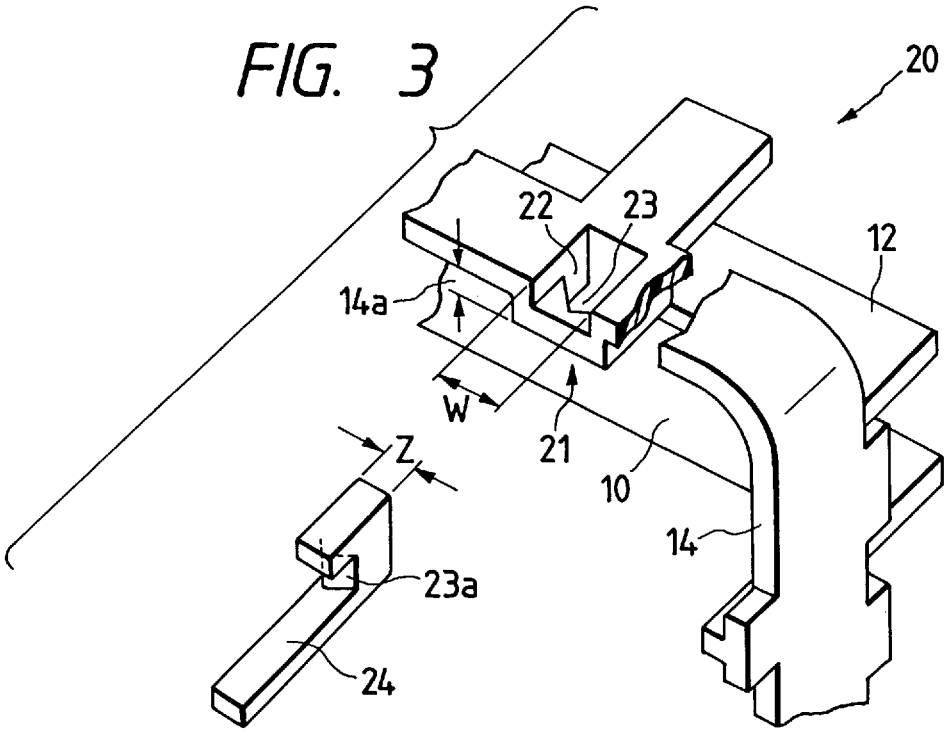
FIG. 3 is an enlarged perspective view showing a modified example of a drawing portion of the front holder of the invention.

The connector device of the invention may be modified as shown in FIG. 3. That is, the drawing portion 21 is arranged in such a manner that the opening 22 having the sloped guide surfaces 23 is bored directly through the circumferential wall portion 14 of the terminal fixing front holder 20 and that the outer circumferential surface of the circumferential wall portion 14 is collapsed by forming a stepped-down portion 14*a* on the circumferential wall portion 14 having the opening 22 bored therethrough lest the drawing tool 24 engaged with the opening 22 should come in contact with the inner surface of the hood portion 2*a*. As a result, the layout of the fitting areas inside the hood portions 2*a* and 32*a* of the male and female housings 2 and 32 become simple, which in turn contribute to improving connector connecting operability.

Figure 4:
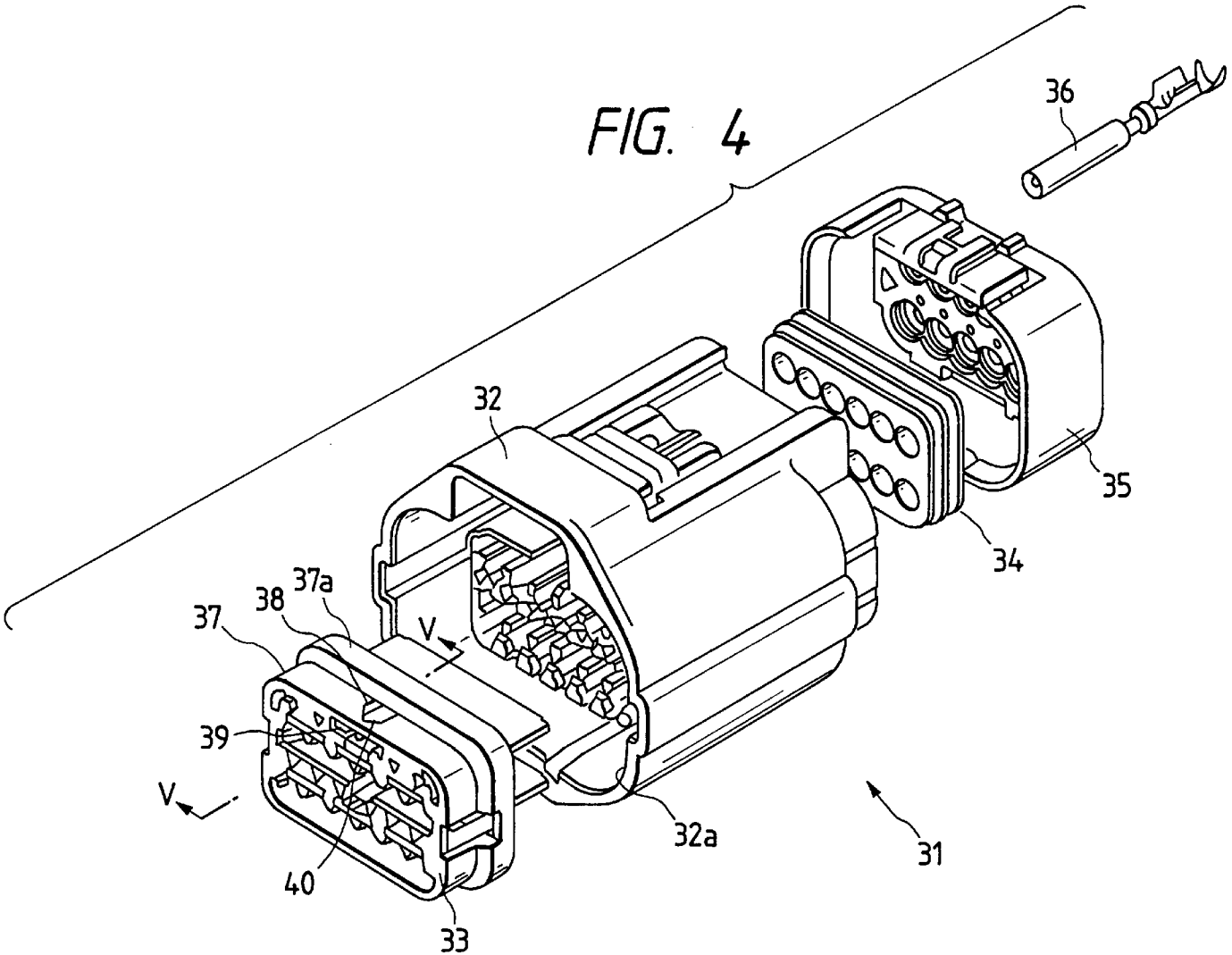
FIG. 4 is an exploded perspective view of a connector having a female terminal in the connector device of the invention.
Figure 5:
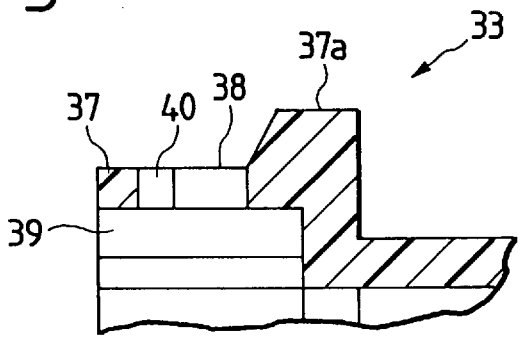
FIG. 5 is a sectional view taken along a line V—V of FIG. 4.
Figure 6:
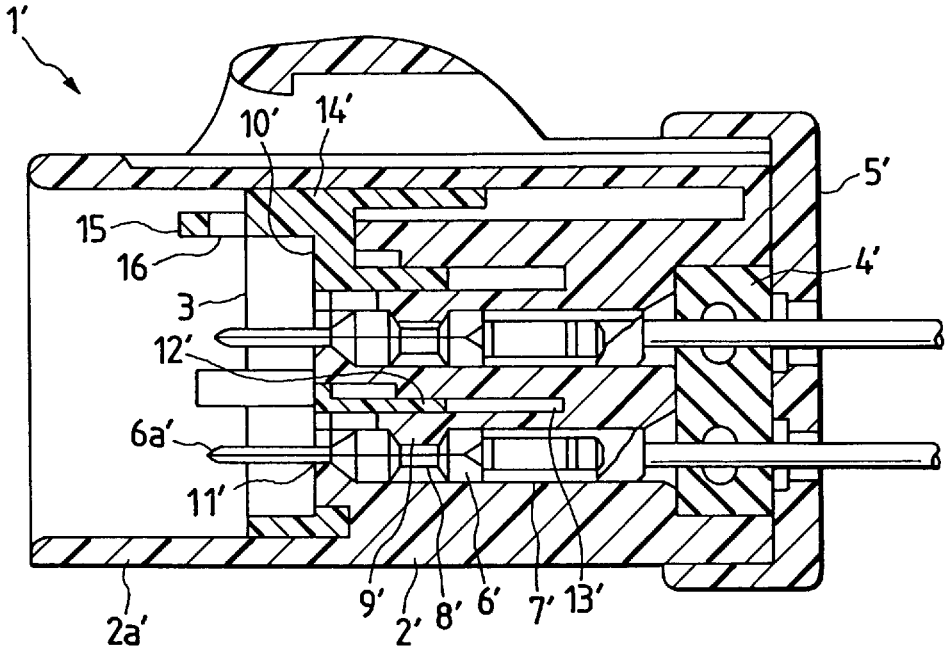
FIG. 6 PRIOR ART
FIG. 6 is a longitudinal sectional view of a conventional connector having a male terminal.
Figure 7:
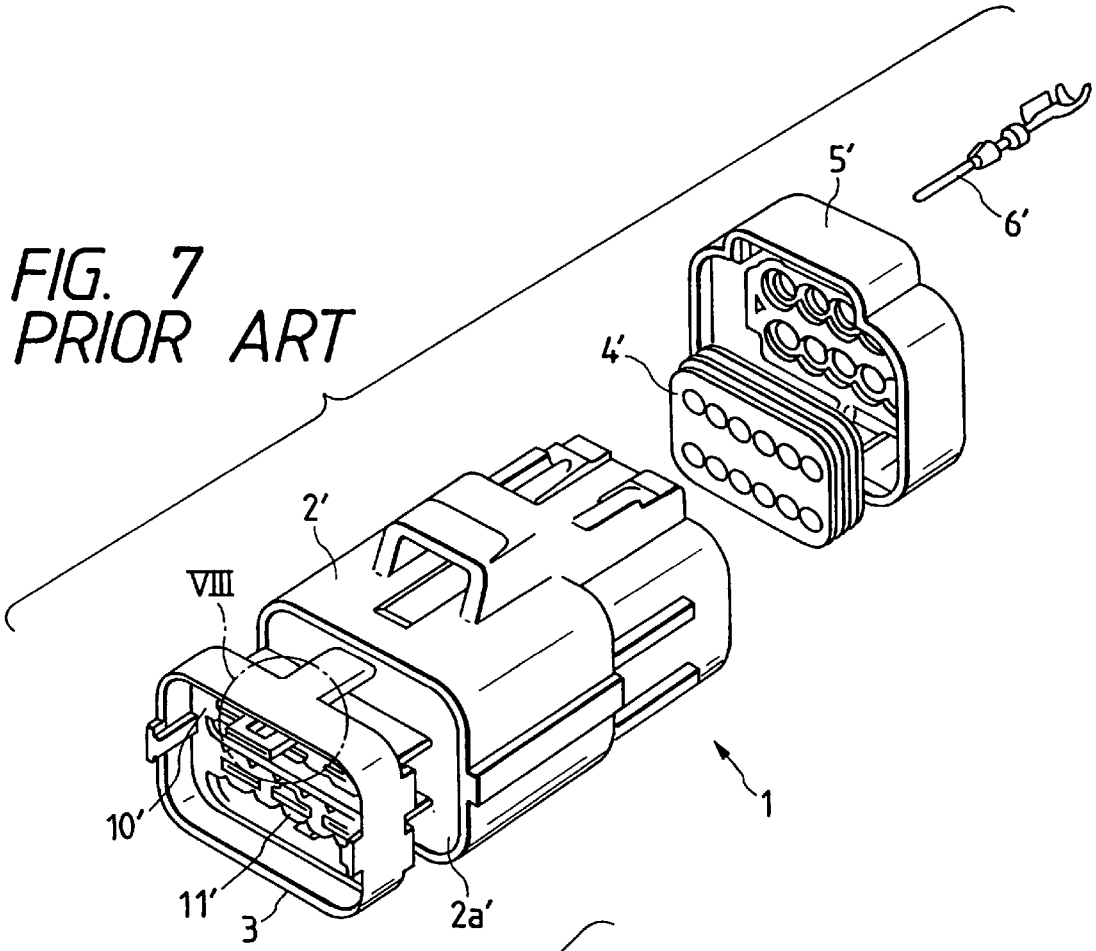
FIG. 7 PRIOR ART
FIG. 7 is an exploded perspective view of the conventional connector having a male terminal.
Figure 8:
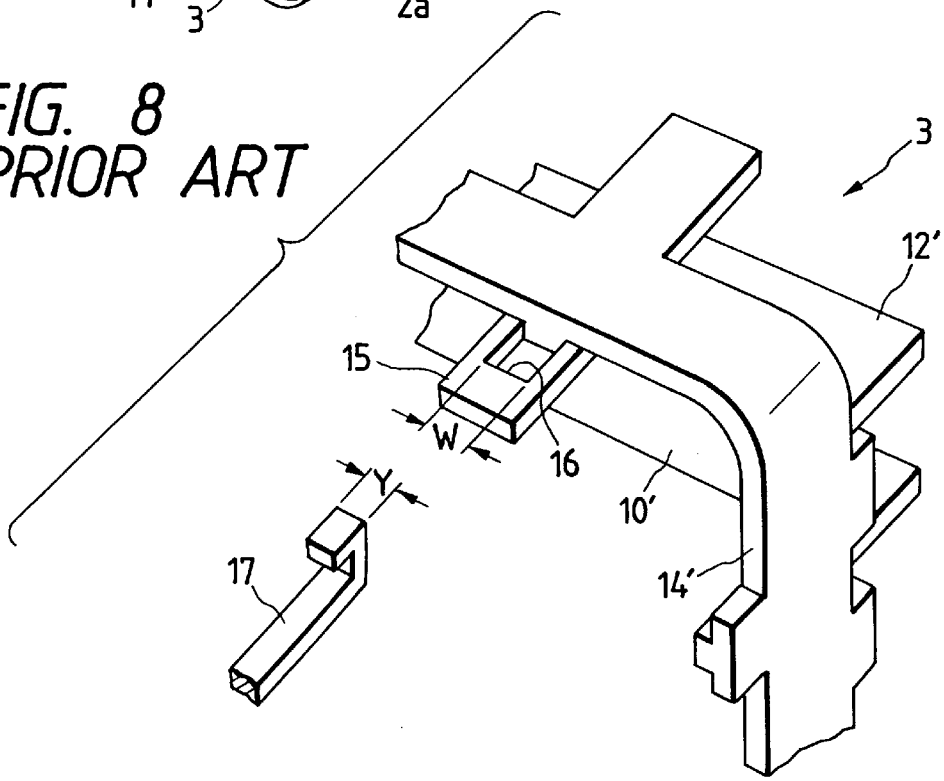
FIG. 8 PRIOR ART
FIG. 8 is an enlarged perspective view of a circle VIII in FIG. 7.

Similarly, as shown in FIGS. 4 and 5, also in a connector 31 having a housing 32, a terminal fixing front holder 33, a mat seal 34, a mat seal cover 35, and a male terminal 36, an opening 38 having sloped guide surfaces 40 can be bored directly through a circumferential wall portion 37 of the terminal fixing front holder 33.

As is apparent from FIG. 5 that shows the vicinity of the opening 38 in cutaway form along a line V—V of FIG. 4, the outer circumferential surface of the circumferential wall portion 37 through which the opening 38 is bored is stepped down inward with respect to a flange portion 37*a* of the circumfernetial wall portion 37, and a clearance 39 through which the drawing tool 24 is inserted and removed is arranged adjacently inside the outer circumferential surface. Therefore, the layout of the fitting areas within the hood portions 2*a* and 32*a* of the male and female housings 2 and 32 become simple, which in turn contribute to improving connector connecting operability. Further, the shape of the front holder is not limited to that of the aforementioned embodiment, but may have engaging pieces that allow the front holder to engage with the terminals directly in place of the spacers.

The thus constructed connector device of the invention can provide the following novel advantages. The connector device of the invention features having the drawing portion 21 on the terminal fixing front holder 20, and boring the opening 22 through the drawing portion 21, the opening 22 having the sloped guide surfaces 23 that can regulate the drawing direction. Therefore, the drawing tool 24 is guided in a predetermined direction along the sloped guide surfaces 23 with respect to the opening 22, which in turn allows the drawing tool 24 to be engaged at a fixed position every time the drawing tool 24 is engaged and, in addition, allows the drawing force of the drawing tool 24 to be applied stably in a predetermined direction.

Since the connector device of the invention includes the opening 22 that has the triangular sloped guide surfaces 23 for drawing in particular, the drawing force is allowed to concentrate on the apex of the triangle, so that the direction in which the drawing force is applied is regulated toward the apex.

Further, the connector device of the invention features arranging the drawing portion 21 in such a manner that the drawing tab 25 has the opening 22 bored therethrough. That is, the drawing tab 25 is arranged adjacent to the circumferential wall portion 14 of the terminal fixing front holder and the opening 22 has the sloped guide surfaces 23. Therefore, the operation of engaging the drawing tool 24 with the opening 22 is further facilitated, and further, the drawing tool 24 is engaged at a fixed position along the sloped guide surfaces 23. As a result, the drawing force of the drawing tool 24 can be applied further stably in a predetermined direction.

The connector device of the invention features arranging the drawing portion 21 in such a manner that the opening 22 having the sloped guide surfaces 23 is bored directly through the circumferential wall portion 14 of the terminal fixing front holder 20 and that the outer circumferential surface of the circumferential wall portion 14 is collapsed by forming a stepped-down portion 14*a* on the circumferential wall portion 14 having the opening 22 bored therethrough lest the drawing tool 24 engaged with the opening 22 should come in contact with the inner surface of the hood portion 2*a*. Therefore, the layout of the fitting areas within the hood portions 2*a* and 32*a* of the male and female housings 2 and 32 become simple, which in turn contribute to improving connector connecting operability.

The connector device of the invention may also be applied to the connector 31 having the housing 32, the terminal fixing front holder 33, the mat seal 34, the mat seal cover 35, and the male terminal 36 in such a modified manner that the opening 38 having the sloped guide surface 40 is bored directly through the circumferential wall 37 of the terminal fixing front holder 33.

The outer circumferential surface of the circumferential wall portion 37 through which the opening 38 is bored is stepped down inward with respect to the flange portion 37*a* of the circumferential wall portion 37, and the clearance 39 through which the drawing tool 24 is inserted and removed, that is arranged adjacently inside the outer circumferential surface. Therefore, the layout of the fitting areas within the hood portions 2*a* and 32*a* of the male and female housings 2 and 32 become simple, which in turn contribute to proving connector connecting operability.

What is claimed is:

1. A connector, comprising:

a housing;

terminal accommodating chambers formed in said housing, said terminal accommodating chambers into which terminals are inserted;

a front holder, for fixing said terminals, inserted into a front portion of said housing; and a drawing portion formed on said front holder, said drawing portion having a hole with at least one engaging surface internally thereof which immediately contacts and engages with a mating surface of a drawing tool upon initial insertion thereof into said hole, said engaging surface and said mating surface being of complementary shape to each other and being configured to prevent relative lateral movement therebetween.

2. The connector of claim 1, wherein said engaging surface and said mating surface are each configured in an apex of a triangular shape.

3. The connector of claim 1, wherein said hole is bored directly through a circumferential wall portion of said front holder.

4. The connector of claim 1, wherein said engaging surface and said mating surface are each configured to form an angle.

5. The connector of claim 1, wherein said mating surface of said drawing tool comprises a pair of sloped engaging surfaces, and said engaging surface of said hole of said drawing portion has a pair of sloped guide surfaces, said sloped engaging surfaces being adapted for to engage with said sloped guide surfaces.

6. A connector comprising:

a housing;

terminal accommodating chambers formed in said housing, said terminal accommodating chambers into which terminals are inserted;

a front holder, for fixing said terminals, inserted into a front portion of said housing; and a drawing portion formed on said front holder, said drawing portion having an opening for engaging with a drawing tool, said opening having a pair of sloped guide surfaces for engagement with said drawing tool in a predetermined direction;

wherein said drawing portion includes a drawing tab arranged adjacent to a circumferential wall portion of said front holder, and wherein said opening is bored through said drawing tab.

7. The connector of claim 6, wherein said drawing tab is arranged so as to project from an inside of said circumferential wall portion.

* * * * *